United States Patent [19]

Anderson

[11] 4,051,983

[45] Oct. 4, 1977

[54] PUMP SPRAYER

[75] Inventor: Walter F. Anderson, West Covina, Calif.

[73] Assignee: Diamond International Corporation, New York, N.Y.

[21] Appl. No.: 633,315

[22] Filed: Nov. 19, 1975

[51] Int. Cl.[2] ..... B05B 1/00

[52] U.S. Cl. ..... 222/321; 239/333; 417/435

[58] Field of Search ..... 222/321, 383, 385; 239/333, 331; 417/435

[56] References Cited

U.S. PATENT DOCUMENTS

| | | | |
|---|---|---|---|
| 3,463,093 | 8/1969 | Pfeiffer et al. | 222/321 X |
| 3,774,849 | 11/1973 | Boris | 222/321 X |
| 3,799,448 | 3/1974 | Nozawa et al. | 222/321 X |
| 3,908,870 | 9/1975 | Nozawa et al. | 222/385 X |
| Re. 28,366 | 3/1975 | Pechstein | 239/333 |

*Primary Examiner*—Stanley H. Tolberg
*Assistant Examiner*—Joseph J. Rolla

[57] ABSTRACT

A dispensing pump having upper and lower pistons defining opposite ends of a two diameter pump chamber, the volume of which is varied by movement together of the pistons, while a small amount of relative movement of the pistons, resulting from pressure changes within the pump chamber, effects opening and closing of the discharge valve. For facilitating the priming of such a pump, the lower piston and cylinder are arranged to define a normally closed priming valve operable at a predetermined point in the lower piston stroke to permit reverse flow of entrapped air from the pump chamber into a liquid supply container with which the pump is associated.

7 Claims, 5 Drawing Figures

PUMP SPRAYER

This invention relates to improvements in atomizing dispensing pumps of the type generally exemplified in the Pechstein U.S. Pat. No. Re. 28,366.

In such pumps, the pump chamber is provided at its inner or lower end with a reduced diameter portion for operative reception of a control piston, against which the return spring exerts an upward force, so that a discharge valve carried by the control piston is urged into seated relation with respect to a discharge passage extending through the main pump plunger which is reciprocally disposed within the larger diameter portion of the pump chamber. In addition to seating the discharge valve, the thrust of the return spring, transmitted through the control piston and discharge valve, suffices to raise both pistons on their intake or suction stroke, following each manually produced downward or compression stroke. The upper and lower pistons thus define opposite ends of a two diameter pump chamber the volume of which is varied by movement substantially together of the pistons, while a small amount of relative movement between the pistons, resulting from pressure changes within the pump chamber effects the opening and closing of the discharge valve.

The discharge passage terminates in conventional manner in a spray discharge nozzle, inherently requiring that the liquid discharged through it be above a predetermined pressure in order to form a proper spray pattern. Such pressure is attained through the pressure of the spring as above mentioned, which maintains the discharge valve closed or seated except when the pressure of liquid in the pump chamber acting on the control piston exceeds the spring pressure required to seat the discharge valve.

However, difficulty has been experienced in priming such a pump, especially where its pump chamber is of relatively large volume, due to the fact that the air initially occupying that chamber is merely elastically compressed on the downward plunger stroke, without attaining a sufficiently high pressure to move relatively apart the plunger and its control piston, so as to unseat the discharge valve from the plunger. On each upward stroke of the plunger, the entrapped air merely re-expands, with the result that little or no liquid is drawn into the pump chamber. Thus an inordinate number of pump strokes is required to prime the pump.

It has been attempted to remedy this difficulty by providing near the lower end of the pump chamber, a groove or passage through which a portion of the entrapped air may pass upwardly around the plunger piston for escape to the atmosphere. However, this results in undesirable upward leakage of the dispensed liquid product by the same route, after the pump is primed and placed in use.

SUMMARY OF THE INVENTION

The present invention has for its primary object to facilitate the priming of such a pump, while avoiding the creation of leakage or other problems.

To this end, the improvement contemplated by the present invention consists in arranging the lower piston and cylinder to define a normally closed priming valve operable at a predetermined point in the lower piston stroke to permit reverse flow of entrapped air from the pump chamber into the liquid supply container with which the pump is associated, whereby to evacuate the entrapped air into the supply container to be replaced by liquid from that container.

IN THE ACCOMPANYING DRAWINGS

DETAILED DESCRIPTION

Figure 1:
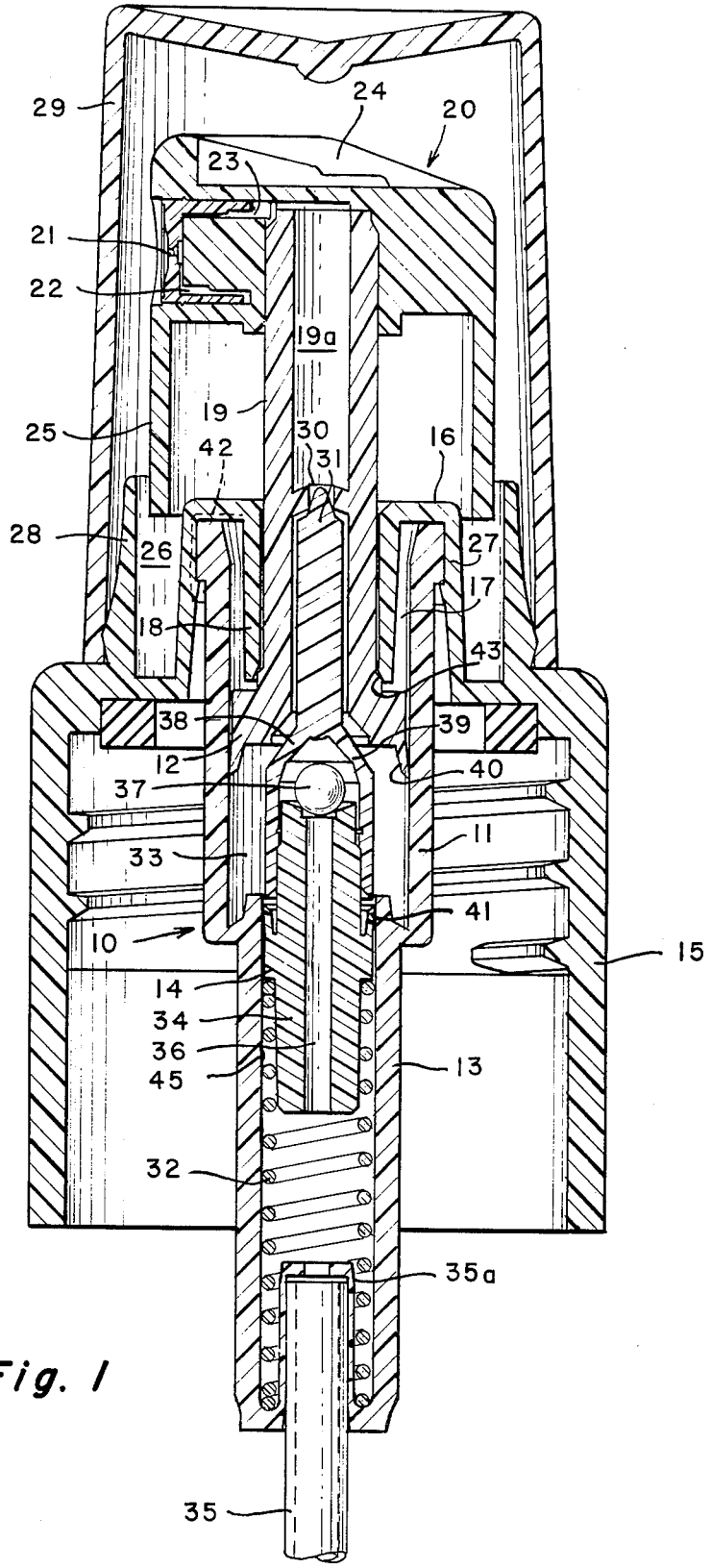
FIG. 1, is an axial cross-sectional view of the pump cylinder and the associated structure of a dispensing pump to which the improvements of the present invention are applied, the pump plunger or piston assembly being in its fully raised in-operative position.
Figure 2:
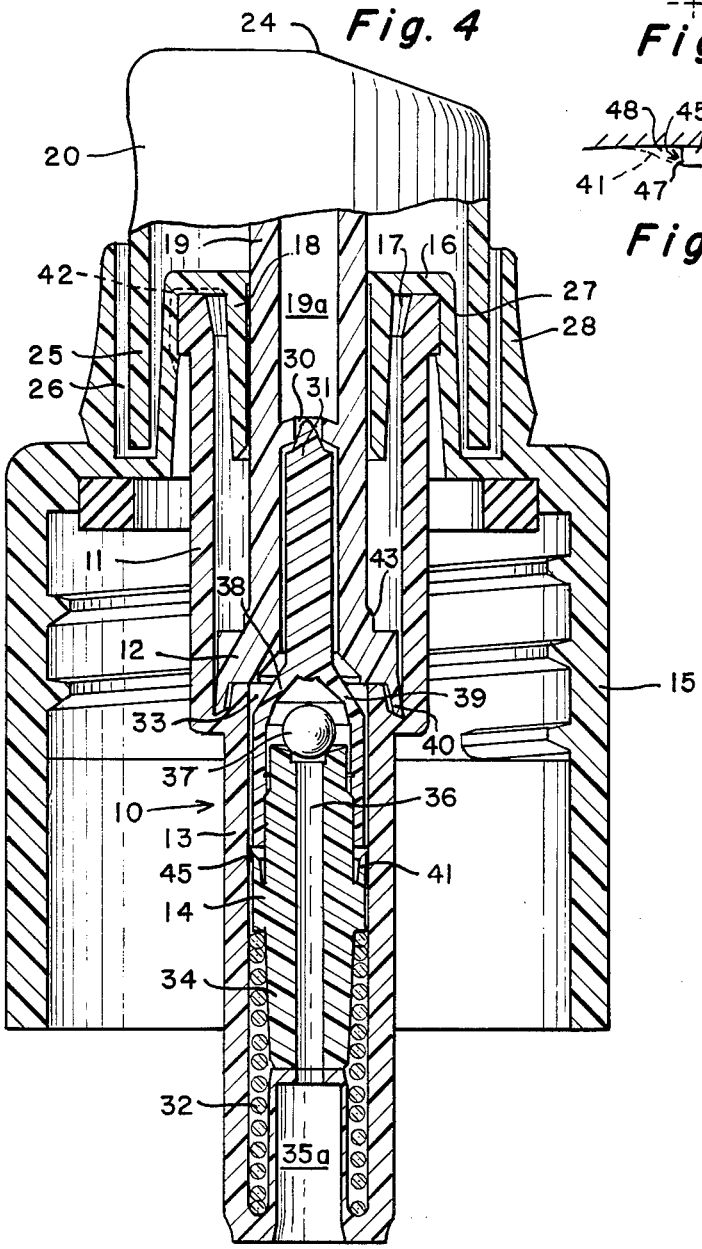
FIG. 2, is a view similar to FIG. 1, but with certain parts removed for clarity, showing the positions assumed by the pump plunger or piston assembly in its fully depressed position at the end of an operative stroke of the pump.

Referring now in detail to the accompanying drawings, and more particularly to FIGS. 1 and 2, there is illustrated in these Figures a dispensing pump of the general type disclosed in the Pechstein, U.S. Pat. No. Re. 28,366. Such a pump comprises a pump housing 10 which defines an upper large diameter pump cylinder 11 having a relatively large diameter pump piston 12 disposed for reciprocation therein, and a relatively smaller diameter pump cylinder 13 having a relatively smaller diameter pump piston 14 disposed there for reciprocation therein. The housing 10, which is open at its upper end is supported by a conventional container closure in the form of an internally threaded cap 15. Cap 15 is adapted to support the pump housing within the interior of a container to dispense the liquid product from the container as desired.

It will be noted that in the present embodiment the cap closure 15 is provided with a centrally domed or raised portion 16 defining an annular downwardly opening recess 17 which receives the upper annular end of the housing 10, and is secured thereto, as by a suitable snap fit to retain the housing in its firmly supported position. The center of the cap also has a central opening defined by a depending collar 18 through which a hollow piston rod 19 from the main or large piston 12 is disposed for reciprocation.

Supported at the upper end of this piston is a conventional spray type discharge head 20 having a spray orifice 21 communicating through suitable passages 22, 23 with the hollow piston rod for discharging the liquid product to the atmosphere in the form of a fine spray.

The upper surface 24 of the spray head is conformed to receive downward finger pressure for the purpose of reciprocating the main piston.

The spray head has a depending cylindrical skirt or shroud 25 which is freely reciprocally received within an annular well 26 defined between generally vertical annular walls 27, 28 formed on the top of the closure cap. If desired a conventional protective over-cap 29 may be applied to and either snap fitted or friction fitted onto the outer wall 28, as shown in FIG. 1.

The hollow piston rod 19 defines a discharge passage 19 a, within which is disposed a valve seat defining a discharge port 30. The port 30 is normally maintained closed by means of a discharge valve 31 carried by the smaller diameter piston 14 for axial movement within the hollow piston rod 19, the discharge valve 31 normally being maintained in its closed or seated position by the resilient thrust of a coil spring 32 compressed between the lower piston 14 and the lower end of its small diameter pump cylinder portion 13. However the discharge valve 31 may be unseated whenever the pressure within the housing 10 between the pistons 12 and 14 exceeds the thrust of the spring. The two pistons and that part of the two diameter housing 10 encompassed between them, define an expansible and contractable pump chamber 33.

It will be observed that the lower or small diameter piston 14 is provided with a tubular or hollow piston rod 34 opening downwardly for reception of liquid product which may be delivered into the lower portion of the small diameter pump cylinder 13 by means of a conventional dip tube 35 (FIG. 1) which is supported by and communicates with the lower end of the small diameter cylinder to place that cylinder at all times in communication with a supply of the liquid to be dispensed from the container or bottle to which the closure cap and its associated pump are applied.

At its upper end, the intake or inlet passage 36 through the smaller diameter piston 14 is controlled by a ball type check valve 37 for preventing back flow of liquid product from the pump chamber 33 to the container.

In the embodiment of the pump herein illustrated, the valve 37 is housed and retained for operative movement within a valve cage 38 having one or more openings 39, through which a liquid product delivered into the cage through the inlet passage 36 may find its way into the surrounding pump chamber 33, to then flow upwardly into discharge passage 19*a* valve 31 and through the discharge valve port 30 when the latter is open, and, thence through the spray nozzle 20 into the atmosphere.

The valve cage constitutes an integral portion of the discharge valve which is initially formed separately from the smaller diameter piston 14, but which is suitably secured over the upper end of the appropriately formed and proportioned lower piston rod 34, as shown in FIG. 1.

Since the dispensed product is compressed with the two diameter pump chamber 33 between the large and small diameter pistons, the resiliently flexible skirts 40 and 41 respectively of these pistons will normally be made to extend in opposed relation. In other words the resiliently flexible skirt 40 of the upper piston has its free edge directed downwardly, while the resiliently flexible skirt 41 of the smaller piston 14 has its free edge directed upwardly, the arrangement being the well known one such that fluid pressure acting against these skirts within the pump chamber will push them radially outwardly into sliding fluid tight engagement with the cylinder walls.

As is conventional in such dispensing pumps, the pump illustrated in FIGS. 1 and 2 is provided with a suitable valve controlled venting means for equalizing the pressures within and outside of the container when the pump is in operation, and for interrupting such communication when the pump is in its stationary or storage position, whereby to prevent leakage or loss of contents.

Thus when the main piston 12 is depressed, air may pass downwardly from the atmosphere through the clearance space between the hollow piston rod 19 and its guide collar 18 to a location within cylinder 11 above the main piston, then may flow through passageway 42 around the upper peripheral edge of the pump chamber, thence downwardly into the container at a location which will be well above the level of liquid therein.

When the main pump piston 12 is in its fully raised position however, such communication is disrupted by means of an annular valve defined by the enlarged diameter portion 43 of the piston rod exterior which seats against the downwardly and outwardly flared inner periphery of the collar 18.

OPERATION

It will be understood that after the pump is primed, it will function substantially in the manner described in the aforesaid Pechstein patent. Assuming the pump chamber 33 to be at least partially filled with the liquid product to be dispensed, together with a residual amount of air and/or liquid vapor, downward finger pressure on the head 20 will initiate downward movement of the upper piston 12 on its operative stroke.

Throughout the initial portion of the stroke, the discharge valve 31 will be retained in closed position be upward pressure of the spring 32 against the lower piston 14. As such movement continues, however, the continuing transfer of liquid from the large diameter upper cylinder 11 into the smaller diameter lower cylinder 13 will increasingly compress the entrapped residual air and/or vapor within the pump chamber 33. At some point in the downward stroke, the degree of compression will be such that the amount of thrust transmitted to the lower piston 14 through the compressed air together with the liquid contents of the pump chamber 32, will exceed the upward thrust of the spring 32, with the result that the lower piston 14 will then move downwardly at a higher velocity than the upper piston. This in turn will cause the discharge valve 31 to open, and to remain open as long as such differential pressure is maintained, during which time the liquid product is discharged through the open discharge passage 19*a* and the spray discharge nozzle. If the pressure drops, however, the discharge valve is automatically closed by the spring pressure to prevent discharge of liquid at a predetermined pressure below that desired.

In the illustrated embodiment, the downward movement of the lower piston is limited by engagement of its hollow piston rod 34 with the upwardly projecting dip tube socket 35*a,* whereby positively to close the discharge valve 31, on completion of the downward stroke of the upper piston.

Thereafter, when finger pressure on the spray discharge head is released, the pistons commence their upward stroke, by energy stored in the spring.

Upward movement of the pistons 12 and 14 produces a pressure drop in the pump chamber 33, causing liquid to be sucked into the pump chamber via the dip tube 35, and the intake passage 36 of the lower piston rod, in readiness for a further downward stroke.

The foregoing pump structure and its mode of operation are generally conventional, but have been briefly described to better promote an understanding of the instant invention.

While such a pump operates in the manner above described, after it has initially been primed, difficulty has been experienced in priming pumps of the type here under consideration, particularly those in which the pump chambers are of comparatively large volume, and thus initially contain substantially large volumes of air to be evacuated and replaced by liquid. It has been found that this difficulty is caused by the fact that the comparatively large volume of air occupying the main pump chamber 33 at the commencement of the priming operation, due to its high compressibility, fails to transmit sufficient thrust between the pistons 12 and 14 to unseat the discharge valve 31. Thus it remains in and, in effect, forms an air lock in the pump chamber 33.

In accordance with the invention, the lower pump cylinder 13 and its piston 14 are arranged to define a priming valve operable at a predetermined point in the lower piston stroke to release entrapped air from the pump chamber into the container with which the pump is associated, whereby a substantial portion of the air within the pump chamber may rapidly be evacuated to be replaced by liquid.

A priming valve structure in accordance with the preferred embodiment of the invention comprises a small ramp or protuberance 45 on the inner wall of the lower pump cylinder 13, located to engage and deflect inwardly a portion of the periphery of the resiliently deformable lower piston 14, when such piston is at or near the lower extremity of its down stroke, thereby permitting downward flow of entrapped air from the pump chamber 33 into the lower cylinder 13, thence through the dip tube 35 and back into the container. To the extent that such air then exerts pressure on the surface of the liquid product, it assists in urging such product through the dip tube 35 and inlet passage on the ensuing upstroke of the pistons. Thus it assists in priming the pump.

Figure 4:
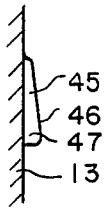
FIG. 4, is a similarly enlarged detail view, partly in elevation and partly in section, on the line 4—4 of FIG. 3; and, FIG. 5, is a similarly enlarged view taken substantially on the line 5—5 of FIG. 3, looking downwardly.
Figure 3:
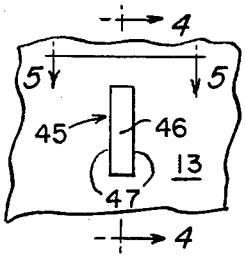
FIG. 3, is a greatly magnified elevational view taken from within the smaller diameter portion of the pump chamber, looking radially outwardly, and illustrating the improvement of the invention as applied to the inner wall of the chamber.
Figure 5:
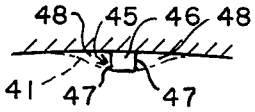

The protuberance 45, as best shown in FIG. 4, has a cam surface or ramp 46 which slopes downwardly and radially inwardly, for radially inwardly deforming the engaged portion of the piston skirt 41, and as shown in FIG. 3, preferably extends only for a very small part of the circumference of the cylinder 13, being provided with relatively opposed side walls 47, at least one of which extends substantially radially to the cylinder wall. Thus when the piston skirt 41 (FIG. 5) is operatively deformed or indented by the protuberance 45, air escape passages 48 of generally triangular configuration are defined by portions of the piston skirt periphery, the inner wall of the lower cylinder 13 and the side walls 47 of the protuberance.

In priming a pump of the type herein described, downward finger pressure is applied against the discharge head whereby to fully depress both pistons in opposition to the thrust of the spring. Throughout such piston movement the air pressure within the cylinders will maintain the inlet valve 37 closed. The discharge valve 31 also will remain closed throughout the downward stroke, by action of the spring 32, unless the air within upper chamber is compressed sufficiently by transfer into the smaller diameter cylinder 13 to unseat the discharge valve by overcoming the thrust of the spring.

If a sufficient degree of air compression is not attained to unseat the discharge valve 31, as is likely to be the case in pumps of the type herein described in which the pump chambers are of comparatively large volume, the entrapped air within the pump chamber 33 will be released through the priming valve passages 48 of the present invention, in substantial increments, at the end of each downward piston stroke, so as to require but a very small number of pump strokes for priming the pump.

The air escape passages 48 will normally be of exceedingly small cross sectional dimensions to prevent return flow of any significant amount of liquid downwardly past the lower piston. However, notwithstanding their small size, clogging of these passages will normally be prevented by the flexing of the piston skirt 41 which occurs incident to their formation.

The protuberance 45 may be replaced by a similarly located groove in the cylinder wall of the lower cylinder, located to define a by-pass passage around the piston skirt. The element 45 in FIG. 3, may be regarded as depicting such a groove. This arrangement however, by failing to flex the piston skirt, lacks the ability of the prefered embodiment to prevent clogging.

Having thus described my invention I claim:

1. In a pump sprayer of the class which includes a pair of relatively aligned upper and lower pistons of large and small diameter respectively working in different diameter portions of a common pump chamber which has its lower end adapted for direct and open communication with a supply of liquid to be dispensed from a container through a dip tube connected to said lower end;

both of said pistons having valve controlled flow passages therethrough to permit only the upward flow of fluid through said pump chamber;

and means for reciprocating said pistons substantially in phase with each other for varying the volume of the pump chamber encompassed between said pistons;

the improvement wherein said small diameter piston is resiliently radially deformable and is normally in sealing relation with the inner wall of said pump chamber throughout its entire circumference;

said inner wall being formed with a protuberance located for engagement with said small diameter piston at a predetermined axial location near the end of the downward stroke of said small diameter piston to locally inwardly deform a portion of the periphery of said piston so that entrapped air may escape from between said pistons into said lower end of the pump chamber and into said container through said dip tube to be replaced by liquid from said container.

2. In a pump sprayer of the class which includes a pair of relatively aligned upper and lower pistons of relatively large and relatively small diameter respectively working in different diameter portions of a common pump chamber which has its lower end adapted for direct and open communication with a supply of liquid to be dispensed from a container through a dip tube connected to said lower end;

both said pistons having valve controlled flow passages therethrough to permit unidirectional upward flow only of the liquid through said pump chamber;

and means for reciprocating said pistons substantially in unison;

the improvement which includes means within the pump chamber co-operating with said small diameter piston near the end of the downward stroke of the latter to permit flow of entrapped air from the pump chamber downwardly past said small diameter piston into the lower end of said pump chamber beneath the small diameter piston and into said container through said dip tube to be replaced by liquid from said container.

3. The combination of claim 2, in which said last mentioned means comprises a generally axially extending groove in the inner wall of said pump chamber positioned to by-pass air entrapped between said pistons downwardly around said small diameter piston into the lower end of the pump chamber therebeneath.

4. The combination of claim 2, in which said small diameter piston has a resiliently radially deformable periphery normally in sealing relation with the inner wall of said pump chamber throughout its entire circumference;

there being a protuberance on said inner wall axially positioned for engagement with said small diameter piston periphery at a location near the end of the downward stroke of said small diameter piston, to locally inwardly deform a portion of said periphery to permit downward flow of fluid from the pump chamber between said pistons into the lower end of said pump chamber beneath said small diameter piston.

5. The combination of claim 4, in which said protuberance is in the form of a ramp having a downwardly and inwardly sloping cam surface for deforming engagement with the piston periphery.

6. The combination of claim 5, in which said small diameter piston is provided with a flexible annular skirt having a radially outwardly and upwardly directed free end edge normally in sealing engagement with said inner wall of the pump chamber.

7. In a pump sprayer comprising a housing which defines a pump chamber having axially aligned intercommunicating upper and lower portions of different diameters, said lower portion being of smaller diameter than said upper portion and adapted for direct and open communication through its lower end with a supply of liquid to be dispensed from a container through a dip tube connected to said lower end;

an upper piston having an upwardly projecting piston rod disposed for reciprocation in said upper portion, said upper piston and piston rod defining portions of a common fluid discharge passage extending from said pump chamber to the atmosphere;

a lower piston disposed for reciprocation in said lower portion of the pump chamber and carrying a discharge valve for movement therewith into and from sealing relation with respect to said discharge passage;

a valve controlled inlet port through said lower piston;

spring means acting through said lower piston for resiliently seating said discharge valve and for urging both said pistons upwardly;

said spring permitting unseating of said discharge valve in a response to fluid pressure within said pump chamber between the respective pistons in excess of the spring pressure required for seating said discharge valve;

the improvement wherein said lower piston is resiliently radially deformable and is normally in sealing relation with the inner wall of said lower portion of the pump chamber throughout its entire circumference;

said inner wall being formed with a protuberance located for engagement with said lower piston at a predetermined axial location near the end of the downward stroke of said lower piston to locally inwardly deform a portion of said piston away from sealing engagement with said inner wall so as to provide a small passage through which entrapped air compressed within the pump chamber above said lower piston may flow downwardly into the lower end of the pump chamber beneath said lower piston and into said container through said dip tube to be replaced by liquid from said container.

* * * * *

US004051983B1

REEXAMINATION CERTIFICATE (2145th)

United States Patent [19]

Anderson

[11] B1 4,051,983

[45] Certificate Issued Dec. 14, 1993

[54] **PUMP SPRAYER *HAVING PUMP PRIMING MEANS***

[75] Inventor: Walter F. Anderson, West Covina, Calif.

[73] Assignee: Calmar Inc., City of Industry, Calif.

Reexamination Request:
No. 90/002,882, Nov. 10, 1992

Reexamination Certificate for:

| | |
|---|---|
| Patent No.: | **4,051,983** |
| Issued: | **Oct. 4, 1977** |
| Appl. No.: | **633,315** |
| Filed: | **Nov. 19, 1975** |

[51] Int. Cl.[5] ..... B65D 88/54

[52] U.S. Cl. ..... 222/321; 239/333; 417/435

[58] Field of Search ..... 222/321, 385, 383; 239/333; 417/435

[56] References Cited

U.S. PATENT DOCUMENTS

| | | | |
|---|---|---|---|
| Re. 28,366 | 3/1975 | Pechstein | 239/333 |
| 3,746,260 | 7/1973 | Boris | 239/321 |
| 3,774,849 | 11/1973 | Boris | 239/338 |
| 4,144,987 | 3/1979 | Kishi | 222/321 |

OTHER PUBLICATIONS

*Calmar's Non-Throttling Pump,* Aerosol Age, Sep., 1975, pp. 36–38.

*Primary Examiner*—Gregory L. Huson

[57] ABSTRACT

A dispensing pump having upper and lower pistons defining opposite ends of a two diameter pump chamber, the volume of which is varied by movement together of the pistons, while a small amount of relative movement of the pistons, resulting from pressure changes within the pump chamber, effects opening and closing of the discharge valve. For facilitating the priming of such a pump, the lower piston and cylinder are arranged to define a normally closed priming valve operable at a predetermined point in the lower piston stroke to permit reverse flow of entrapped air from the pump chamber into a liquid supply container with which the pump is associated.

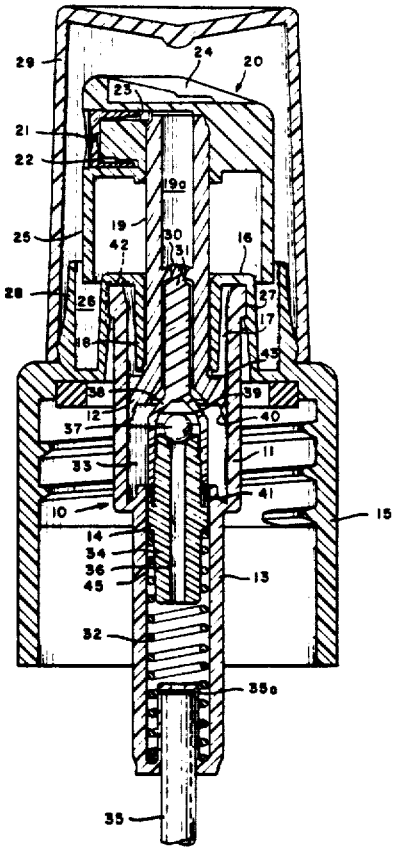

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 to 7 is confirmed.

* * * * *